US006199966B1

(12) United States Patent
Fulterer

(10) Patent No.: US 6,199,966 B1
(45) Date of Patent: Mar. 13, 2001

(54) PULL-OUT DEVICE FOR A TALL CUPBOARD

(75) Inventor: Manfred Fulterer, Lustenau (AT)

(73) Assignee: Fulterer Gesellschaft m.b.H., Lustenau (AT)

( * ) Notice: Subject to any disclaimer, the term of this patent is extended or adjusted under 35 U.S.C. 154(b) by 0 days.

(21) Appl. No.: 09/262,140

(22) Filed: Mar. 3, 1999

(30) Foreign Application Priority Data

| | | |
|---|---|---|
| Mar. 4, 1998 | (AT) | 374/98 |
| May 11, 1998 | (AT) | 789/98 |
| May 11, 1998 | (AT) | 790/98 |

(51) Int. Cl.[7] ..... A47B 88/00

(52) U.S. Cl. ..... 312/334.24; 312/270.3; 312/330.1; 312/334.9

(58) Field of Search ..... 312/334.24, 334.25, 312/334.26, 334.31, 334.33, 334.44, 350, 334.12, 205, 204, 270.3, 330.1, 334.9, 334.14, 334.27, 334.28

(56) References Cited

U.S. PATENT DOCUMENTS

| | | | | |
|---|---|---|---|---|
| 2,846,286 | * | 8/1958 | Gomersall | 312/270.3 |
| 3,289,044 | * | 11/1966 | Ginsberg | 312/334.27 X |
| 3,387,906 | * | 6/1968 | Edwards | 312/334.25 |
| 5,070,556 | * | 12/1991 | Gloger | 312/334.25 X |
| 5,275,483 | * | 1/1994 | Rasmussen | 312/334.27 X |
| 5,344,228 | * | 9/1994 | Kovarik et al. | 312/334.9 |
| 5,468,063 | * | 11/1995 | Simonek | 312/334.28 |
| 5,520,452 | * | 5/1996 | Peterson et al. | 312/330.1 X |

* cited by examiner

*Primary Examiner*—Peter M. Cuomo
*Assistant Examiner*—Stephen Vu
(74) *Attorney, Agent, or Firm*—Brown & Wood, LLP

(57) ABSTRACT

A pull-out device for a tall cup-board including a pull-out section having a bottom the pull-out device having at least a U-shaped carcass rail, a pull-out rail with which the pull-out section is connected and which has two, spaced from each other, vertical webs, and an adaptor rail for connecting the bottom of the pull-out section with the pull-out rail, the adaptor rail having an element securable to the bottom of the pull-out section and a vertical web formlockingly retainable between the vertical webs of the pull-out rail and securable against axial displacement relative to the pull-out rail.

11 Claims, 7 Drawing Sheets

Fig. 1
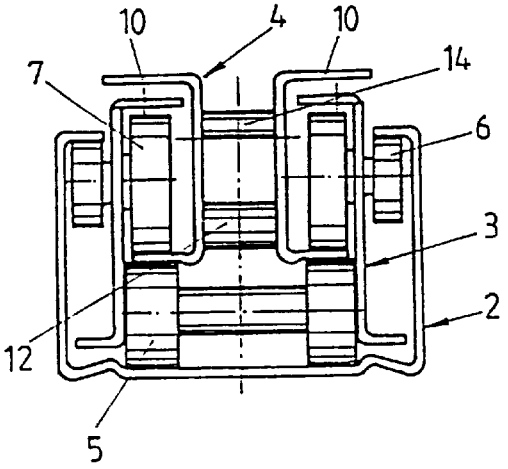
Fig. 8
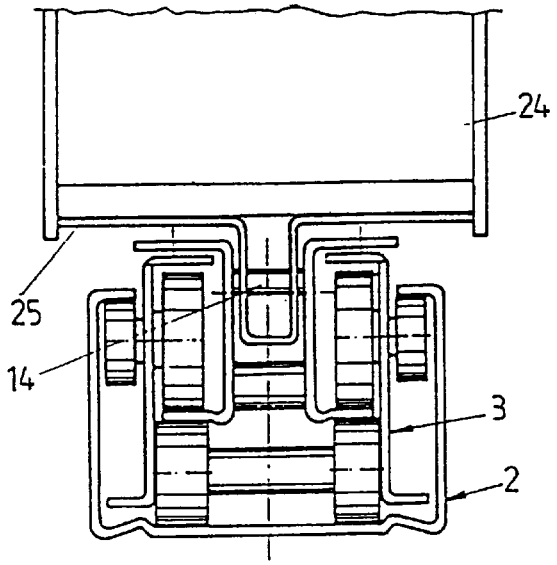
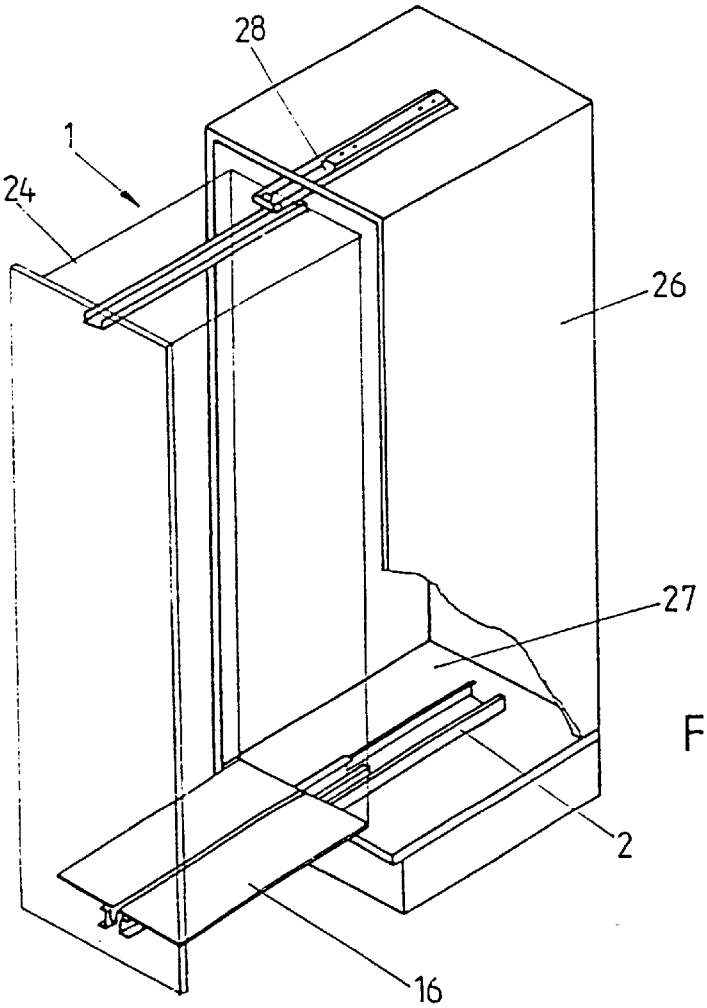
Fig. 9

A
B
C
D
E
F
G
H
I
III
4
8
9
10
11
13
14
15
16
17
18
19
20
21
22
23
24
25

PULL-OUT DEVICE FOR A TALL CUPBOARD

BACKGROUND OF THE INVENTION

1. Field of the Invention

The present invention relates to a pull-out device for a tall cupboard and including a U-shaped carcass rail, a pull-out rail having two spaced vertical webs and, if necessary, an intermediate rail arrangeable between the carcass and pull-out rails, with running rollers provided on at least one of the rails. A section of the tall cupboard, which is connected to the pull-out rail is usually formed either as a box-like section or as a circumferentially closed frame which is formed of a profile material and has upper and lower horizontal bars and two vertical bars connecting the horizontal bars.

2. Description of the Prior Art

There exists numerous different embodiments of pull-out devices for tall cupboards. Different types of pull-out devices are described in, e.g., U.S. Pat. Nos. 3,450,446 and 3,901,525; Austrian Publications A-2199/97, A-924/97 and A-2199/96; prospects of firms "PEKA Metall AG", "Hettlich International 9.34–9.35 and "Fulterer" Hochschrank-differentialrollauszug. In the disclosed pull-out devices, the pull-out rail has, as a rule, U-shaped cross-section. With regard to the arrangement of the U-shaped pull-out rail in the pull-out device, there exist two types of pull-out devices. In one type of pull-out devices, the pull-out rail is so arranged that its open side faces downward, with the projecting rim flanges of the rail cooperating with the running rollers. In the other type of a pull-out device, the open side of the pull-out rail faces upward. There exist two embodiments of a pull-out section of a tall cupboard which is attachable to an upwardly facing pull-out rail. According to one embodiment of a pull-out section, it is formed as a rectangular frame made of a profile material having a square cross-section, with the shelves or trays suspended from the vertical bars. According to another embodiment, the pull-out section is formed as a box with a bottom. The pull-out rail is attached to the bottom of the box-like section with its side flanges. During the attachment of the pull-out device to the tall cupboard, first, the carcass rail and, if used, the intermediate rail are attached to the bottom of the tall cupboard. The pull-out rail is secured to the bottom of the pull-out section of the cupboard. Usually, the pull-out rail is screwed to the bottom of the pull-out section. Then, the pull-out section of a tall cupboard, together with the pull-out rail, is inserted into the rail attached to the bottom of the tall cupboard. This is not only a heavy work but also a very cumbersome work because the sidewise projecting flanges of these rails should be arranged between running rollers which are located at different heights.

A pull-out device for a pull-out section in which the rails are arranged between rolling means located at different heights is disclosed in U.S. Pat. No. 3,901,566. The U.S. Pat. No. 3,901,566 discloses a drawer guide in which the guide-forming rails are supported by balls. Such drawer guides with ball-supported guide rails has an advantage over the guides with roller-supported guide rails which consists in that the guides with the ball-supported guide rails cannot be disassembled or dismantled. The drawer guides with ball-supported guide rails include a carcass rail, a loading rail and, if necessary, a telescopic or differential rail and are formed as separate units which then are inserted into a furniture piece in pairs. The drawer itself is provided with side connecting braces which provides for attachment of the drawer to its guide. The connecting braces can have many different forms and consist, as a rule, of a hook member and a pivotal key-bolt.

German Publication DE 197 06 246A1 discloses a telescopic pull-out device for a tall cupboard. The pull-out rail, to which the tall cupboard is attached, has, at its end side, vertically arranged screws which serve as adjusting screws for vertically adjusting the cupboard after the attachment of the pull-out device.

An object of the present invention is to provide a pull-out device for a tall cupboard which would facilitate mounting a pull-out section of the tall cupboard on the pull-out rail.

SUMMARY OF THE INVENTION

This and other object of the present invention, which will become apparent hereinafter, are achieved by providing an adaptor rail having a vertical web which is formlockingly received between the vertical webs of the pull-out rail, without a possibility of an axial displacement relative to the pull-out rail. When the pull-out section is formed as a box-like section, the adaptor rail is formed as T-shaped rail the horizontal flange of which is attachable to the bottom of the box-like section. When the pull-out section is formed as a circumferentially closed rectangular frame, the lower horizontal bar of the frame functions as the vertical web of the adaptor rail. Providing of an adaptor rail permits to completely mount the pull-out device on the bottom of the tall cupboard or other furniture piece, including the pull-out rail. After mounting the pull-out device, the pull-out section having the adaptor rail attached thereto, is mounted on the pull-out rail.

Advantageously, it is contemplated that the adaptor rail can pivot relatively to the pull-out rail about a transverse axis lying in the longitudinally middle region of the adaptor rail. This permits to vertically align the pull-out section during mounting, insuring a precise assembly.

This advantage is available independent of whether the pull-out section is formed as a box-like section or as a circumferentially closed frame.

BRIEF DESCRIPTION OF THE DRAWINGS

The features and objects of the present invention will become more apparent, and the invention itself will be best understood from the following detailed description of the preferred embodiments when read with reference to the accompanying drawings, wherein:

FIG. 1 shows a front view of a three-rail pull-out device for a tall cupboard;

FIG. 8 shows a front view of the pull-out device shown in FIG. 1 with the lower portion of the pull-out tall cupboard shown in FIG. 7;

FIG. 9 shows a schematic perspective angular view of a tall cupboard with a pull-out section;

DESCRIPTION OF THE PREFERRED EMBODIMENT

Figures 2, 3, 4, 5, 6, 7:
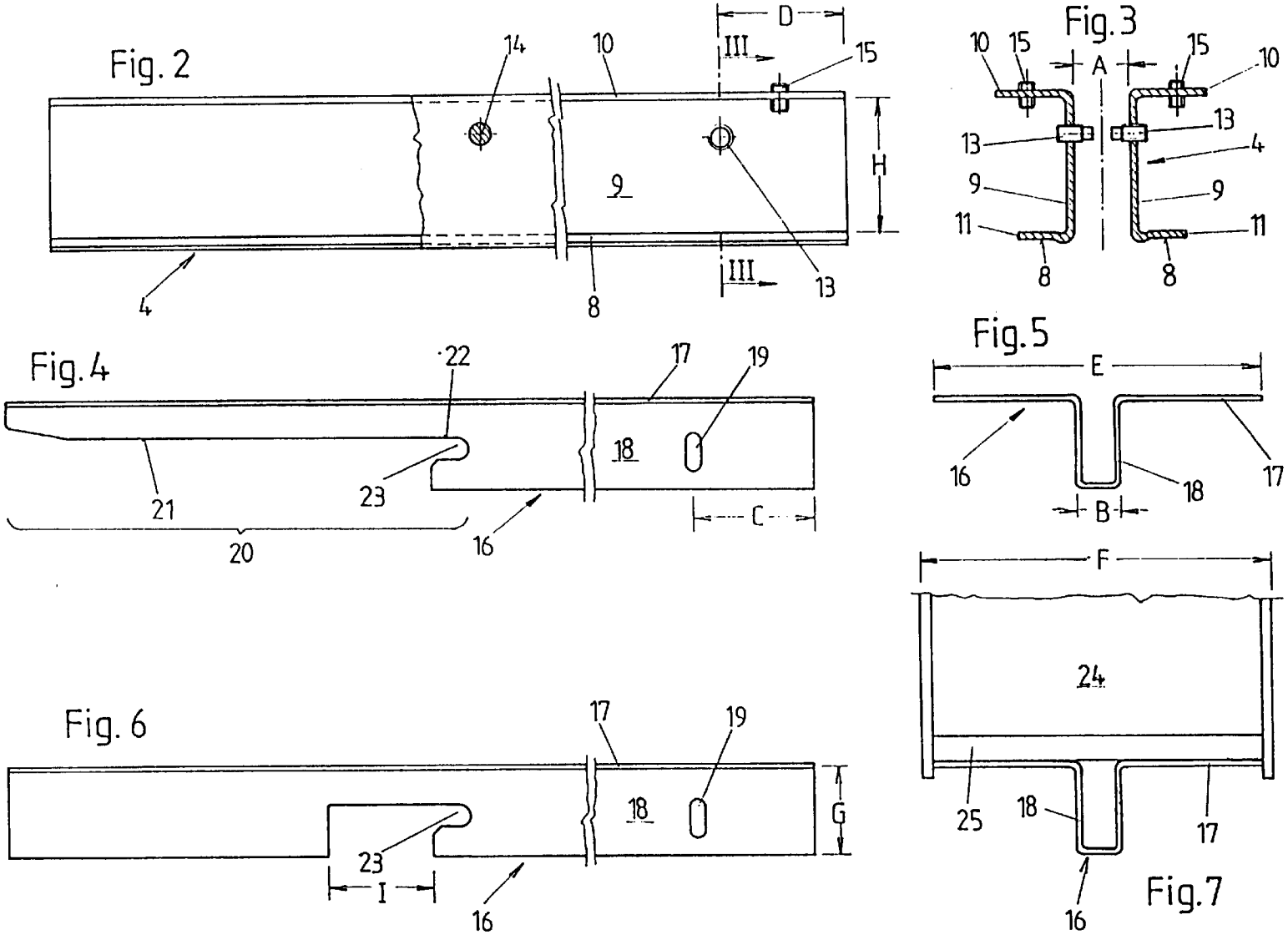
FIG. 2 shows a side view of a pull-out rail of the pull-out device shown in FIG. 1.
FIG. 3 shows a cross-sectional view along line III—III in FIG. 2.
FIG. 4 shows a side view of an adaptor rail.
FIG. 5 shows a front view of the adaptor rail shown in FIG. 4.
FIG. 6 shows a side view of another embodiment of an adaptor rail.
FIG. 7 shows a front view of a lower portion of a pull-out tall cupboard with an adaptor rail secured thereto.

In the drawings described below, the same elements are shown in different figures at a different scale, and the same or functionally same elements are designated with the same reference numerals.

A pull-out device for a tall cupboard and which is shown in FIG. 1, includes a U-shaped carcass rail 2, an intermediate rail 3, which is formed of two Z-profiles connected with crossbolts, and a pull-out rail 4. The three rails 2, 3 and 4 are axially displaced relative to each other in a conventional manner due to provision of running rollers 5, 6 and 7. In a pull-out device of the type described above, the running rollers, as a rule, are supported on the intermediate rail, i.e., the running rollers 5, 6, 7 are supported on the intermediate rail 3. It should be pointed out that the present invention, which is described in detail below, is not limited to a three-rail pull-out device and is equally applicable to a pull-out device having less than three or more than three rails.

In the pull-out device shown in FIG. 1, the pull-out rail 4 is formed of two U-shaped profiles 8 the vertical webs 9 of which are located adjacent to each other. The vertical webs 9 of the two U-shaped profiles 8 are spaced from each other by a distance "A". Each of the U-shaped profile 8 has an upper flange 10 and a lower flange 11 which forms a track for the running rollers. The two U-shaped profiles 8 are connected with each other by a transverse spar 12 and form a unit. However, the transverse spar 12 is functionally irrelevant with regard to the present invention. Instead of two U-shaped profiles 8, the pull-out rail 4 can be formed of single, upwardly opening, U-shaped profile having upper, outwardly bent-out rims.

In its end region, the pull-out rail 4 is provided, in the upper half of the height H of the vertical web 9 with screwed-in threaded bolts 13 which are aligned with each other. Each threaded bolt 13 has, at its inner end surface, a journal-like projection. The pull-out rail 4 is further provided with a bolt 14 which connects the two vertical webs 9 and is arranged in the longitudinally central region of the pull-out rail 4 in the upper portion of the vertical webs 9. In the end regions of the sidewisely projecting flanges 10 of the two U-shaped profiles 8, there are provided threaded bores for receiving vertically extending adjusting screws 15.

FIGS. 4 and 5 show side and front view of an adaptor rail 16 according to the present invention. The adaptor rail 16 has a T-shaped cross-section with a horizontal flange 17 and a vertical web 18 having a U-shaped profile. The outer width B of the vertical web 18 of The adaptor rail 16 is somewhat smaller than the inner width A of the pull-out rail 4. Vertical elongate holes 19 are provided in the end region of the vertical web 18 at a distance C from an end surface of the adaptor rail 16. The distance C corresponds to a distance D at which the threaded bolt 13 are arranged in the pull-out rail 4. The rear portion 20 of the web 18 has a reduced height, and the lower edge 21 of the rear portion 20, in the longitudinally middle region of the adaptor rail 16, passes into an upper edge 22 of a recess 23 opening inward. The width E of the horizontal flange 17 of the adaptor rail 16 is somewhat smaller than the width F of a pull-out portion 24 of a tall cupboard and to bottom 25 of which the flange 17 is screwed.

The axial lengths of the pull-out device and the adaptor rail 16 correspond to each other.

For mounting the pull-out device shown in FIG. 1 in a tall cupboard, the carcass rail 2 is secured to a bottom 27 of a cupboard member 26, and then the intermediate rail 3 and the pull-out rail 4 are inserted, and the pull-out device becomes operative. Only the adaptor rail 16 is secured to the bottom 25 of the pull-out section 24 of the tall cupboard. Then, the pull-out section 24, together with the adaptor rail 16 screwed to the bottom 25, is mounted on the pull-out rail 4, with the vertical web 18 of the adaptor rail 16 being inserted between the vertical webs 9 of the pull-out rail 4, with the threaded bolts 13 having been preliminary withdrawn. The threaded bolts 13 have, as it has already been discussed previously, journal-like projections the diameter of which only slightly smaller than the width of the hole 19, so that these journal-like projections of the threaded bolts 13 can extend into the hole 19 as soon as the webs 9 and the web 18 overlap each other. The lower edge 21 of the vertical web 18 lies on the bolt 14 whereby the pull-out section 24 is pushed backward in the insertion direction of the pull-out device. The bolt 14 is located at that in the recess 23, and the vertical hole 19 becomes aligned with the threaded bolts 13. Thereafter, the bolts 13 are screwed in, and their journal-like projections extend into the vertical hole 19, becoming formlockingly engaged therein.

The respective shoulders of the threaded bolts 13 between the journal-like projections and the threaded portions of the bolts 13 abut the edges of the elongate hole 19. Thereby, the web 18 of the adaptor rail 16 is held from both 13 of the pull-out rail 4 and the vertically elongate hole 19 of the adaptor rail 16 permit to adjust the vertical position of the adaptor rail 16 with respect to the pull-out rail 4 and to fix the adaptor rail 16 in this position. The vertical adjusting screws 15 permit to pivot the adaptor rail 16 and the pull-out section 24 about the axis of the bolt 14 and align them vertically. The adaptor rail 16 is formlockingly held with respect to the pull-out rail 4 in the axial direction. In FIG. 8, for the sake of clarity, the adjusting screws 15 and the horizontal threaded bolts 13 are represented only by their axis.

FIG. 6 shows another embodiment of an adaptor rail 16. In FIG. 6, the recess 23 opens downwardly, and the web 18 has the same width along its entire height G. The insertion of this adaptor rail 16 into the pull-out device requires a greater care and attention because during the insertion, care should be taken that the recess I, i.e., the recess 23 overlaps the bolt 14, whereas with the use of the adaptor rail 16 shown in FIG. 4, no specific measures for insuring that the recess 23 coincides with the bolt 14, are necessary. The shorter rear portion 20 extend almost over a half of the axial length of the adaptor rail 16 shown in FIG. 4.

With the pull-out devices for a tall cupboard of a type described above, guides 28 are usually provided on the cupboard ceiling. These guides have a conventional construction and therefore, would not be described in detail. FIG. 9 shows a tall cupboard 1 with a pulled-out section 24 and a pull-out device shown in FIG. 1 and secured to the bottom 27 of the cupboard. The pull-out device includes an adaptor rail 16.

It is within the scope of the invention to form the adaptor rail of several parts and connect them together with crossbolts and other connection means. In the embodiments of the adaptor rail shown in the drawings, the adaptor rail is formed as a one-piece part. As discussed above, the width B of the vertical web 18 of the adaptor rail 16 is smaller than the width A of the pull-out rail 4. To compensate for this width difference, the vertical webs 9 of the pull-out rail 4 can be provided with downward extending indentations, or these vertical webs 9 can be formed as free-stamped fish plates bent-out inward toward each other and acting as a plate spring, with the vertical web 18 of the adaptor rail 16 being received between the so-formed vertical webs 9. The front formlocking connection between the pull-out rail 4 and the adaptor rail 16 is insured by the threaded bolt 13 and the vertical elongate hole 19 formed in the web 18 of the adaptor rail 16. Instead of threaded bolts 13, spring-biased locking elements can be used which can be built-in in the vertical web 18 because the width B of the web 18 provides sufficient space for such locking elements and their parts. These locking elements can be so formed that they can be displaced in a horizontal plane or can pivot about a horizontal axis, a necessary condition being that the locking elements cooperate with the vertical holes. In this case, the vertical holes are formed in the vertical webs of the pull-out rail 4.

A pull-out device, which is shown in FIGS. 10–15, likewise has a U-shaped carcass rail 2, intermediate rail 3, which is formed of two Z-profiles connected with crossbolts, and a pull-out rail 4. The three rails 2, 3 and 4 are axially displaced relative to each other in a conventional manner due to provision of running rollers 5, 6 and 7. In a pull-out device of the type described above, the running rollers, as a rule, are supported on the intermediate rail, i.e., the running rollers 5, 6, 7 are supported on the intermediate rail 3. It should be pointed out that the present invention, which is described in detail below, is not limited to a three-rail pull-out device and is equally applicable to a pull-out device having less than three or more than three rails.

The pull-out rail 4 is formed of two U-shaped profiles 8 the vertical webs 9 of which are located adjacent to each other. The vertical webs 9 of the two U-shaped profiles 8 are spaced from each other by a distance "A". Each of the U-shaped profile 8 has an upper flange 10 and a lower flange 11 which forms a track for the running rollers. The two U-shaped profiles 8 are connected with each other by a transverse spar 12 and form a unit. However, the transverse spar 12 is functionally irrelevant with regard to the present invention. Instead of two U-shaped profiles 8, the pull-out rail 4 can be formed of a single, upwardly opening, U-shaped profile having upper, outwardly bent-out rims.

In its end region, the pull-out rail 4 is provided, in the upper half of the height H of the vertical web 9 with screwed-in threaded bolts 13. Further, in this embodiment of a pull-out device, there is provided a stop 30 which limit the pull-out path of the pull-out rail 4 relative to the intermediate rail 3.

In the embodiment of a pull-out device shown in FIGS. 10–15, a threaded bore is provided in the transverse spar 12 for receiving an adjusting screw 15 provided with a knurled disc 31 for manually operating the screw 15. At the end surface of the adjusting screw 15, there is provided a bearing disc 32 the diameter of which is somewhat larger than the diameter of the screw 15. A vertical elongate hole is provided in the screw 15 in which a spring-biased indexing bolt 33 is arranged. The indexing bolt 33 projects above the bearing disc 32. With a disc 34, the indexing bolt 33 can be pulled downward and retained in its downward position. The disc 34 is so formed that it projects beyond the knurled disc 31 only on two diametrically opposite sides. Further, in the longitudinally middle region of the pull-out rail 4, there are provided two pairs of pressure pads 35 which extend substantially horizontally. The pressure pads 35 can either be welded to the vertical webs 9 or be formed by free-stamped fishplates. In the embodiment shown in the drawings, the pads are bent along their entire length. It is possible to make the pads 35 rectilinear and extending parallel to each other, with only their portions, which are adjacent to the end surface of the pull-out rail 4 having a funnel shape.

Figure 15:
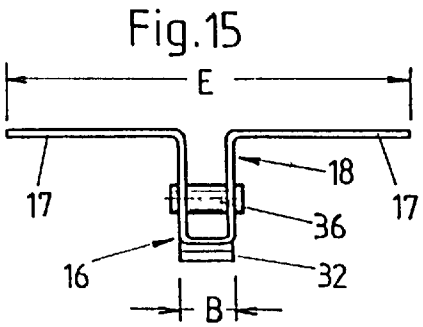
FIG. 15 shows a front view of an adaptor rail shown in FIG. 14.
Figure 12:
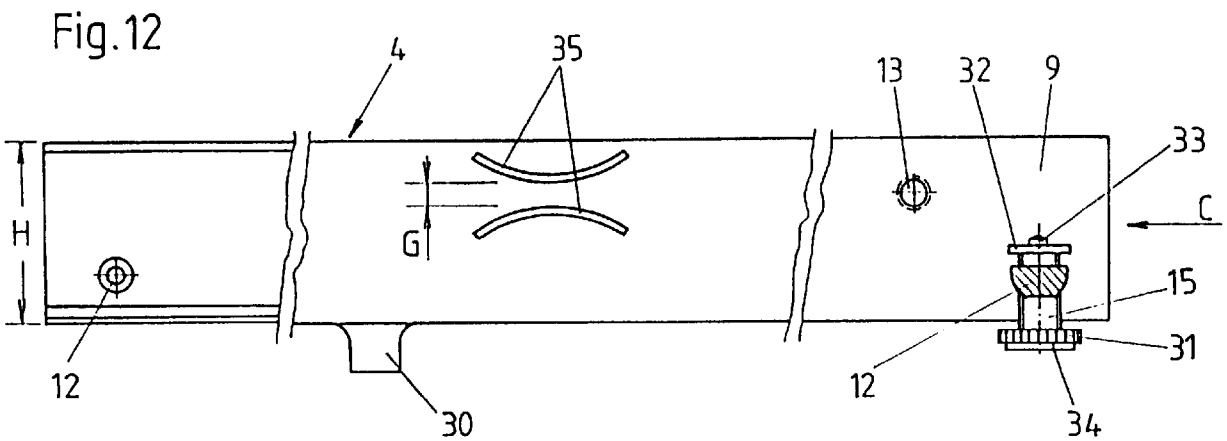
FIG. 12 shows a side view of the pull-out rail of the pull-out device shown in FIG. 10.
Figure 14:
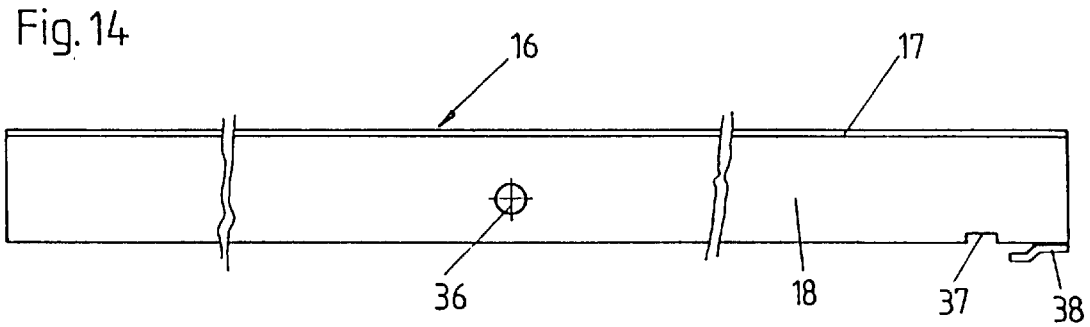
FIG. 14 shows a side view of yet another embodiment of an adaptor rail.

FIGS. 14 and 15 show side and front views of the adaptor rail 16 of the modified embodiment of the pull-out device. The adaptor rail 16 has a T-shaped cross section with a horizontal flange 17 and a vertical web 18 having a U-shaped cross section. The width B of the vertical web 18 is slightly smaller than the width A of the pull-out rail. The width E of the horizontal flange 17 is somewhat smaller than the width F of the pull-out section 24 of the tall cupboard and to bottom 25 of which the flange 17 is screwed. In the longitudinally middle region of the adaptor rail 16, only a bolt 36 is provided which extends through the U-shaped vertical web 18. The diameter of the bolt 36 is somewhat smaller than the distance G between the pad 35. The bottom of the web 18 has, in its front region, a recessed groove 37 and a fishplate 38 located adjacent to the groove 37. The fishplate 38 has a downwardly projecting section bent at a right angle.

The axial lengths of the pull-out device and the adaptor rail corresponds to each other.

Figure 10:
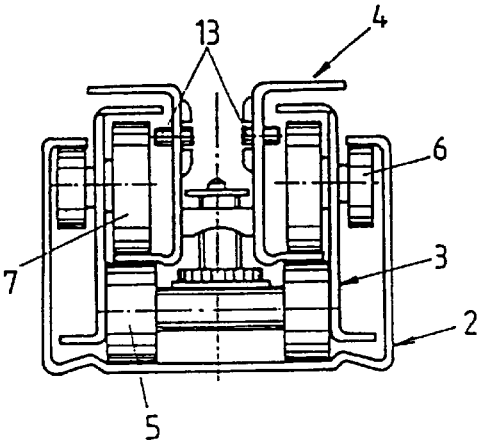
FIG. 10 shows a front view of another embodiment of three-rail pull-out device for a tall cupboard.
Figure 11:
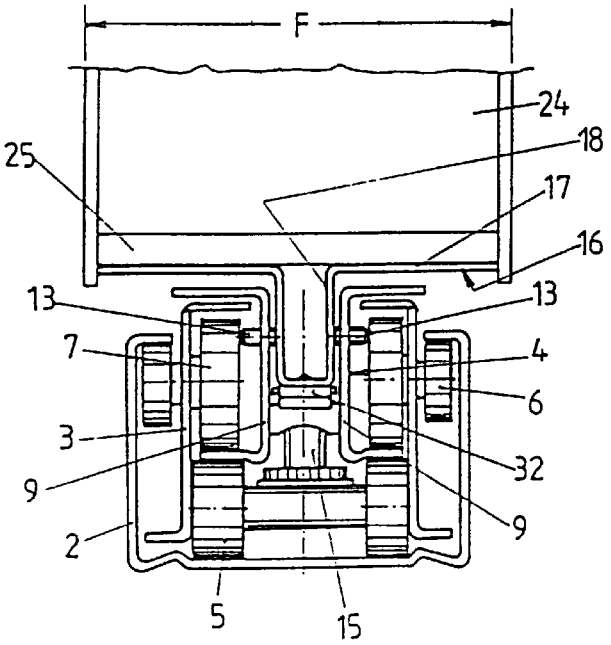
FIG. 11 shows a front view of the pull-out device shown in FIG. 10 with a lower portion of the pull-out section of the tall cupboard.
Figure 13:
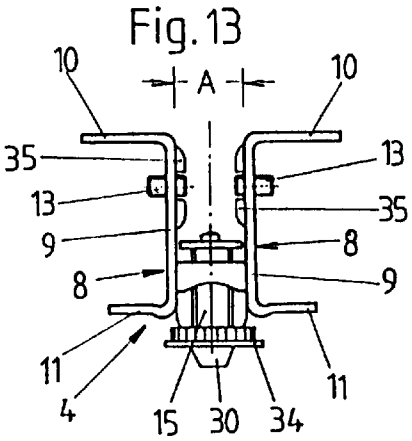
FIG. 13 shows an end view in a direction of arrow C in FIG. 12.

For mounting the pull-out device shown in FIG. 10 in a tall cupboard, the carcass rail 2 is secured to a bottom 27 of a cupboard member 26, and then the intermediate rail 3 and the pull-out rail 4 are inserted, and the pull-out device becomes operative. Only the adaptor rail 16 is secured to the bottom 25 of the pull-out section 24 of the tall cupboard. Then, the pull-out section 24, together with the adaptor rail 16 screwed to the bottom 25, is mounted on the pull-out rail 4, with the vertical web 18 of the adaptor rail 16 being inserted between the vertical webs 9 of the pull-out device 4, with the threaded bolts 13 having been preliminary withdrawn. The horizontal flange 17 of the adaptor rail 16 lies on the upper flanges 10 of the pull-out rail 4, whereas the pull-out section 24 is pushed rearwardly in the insertion direction of the pull-out device. The indexing bolt 33 is pressed downwardly by the web 18 which lies on it. With this, the bolt 36 is pushed between the pads 35. As soon as the recess 37 covers the spring-biased indexing bolt 33, it springs upward and becomes form lockingly engaged in the recessed groove 37. In addition, the front end of the fishplate 38 engages from beneath the edge of the bearing disc 32. The adjusting screw 15 provides for adjustment of the adaptor rail 16 in the vertical direction, and the threaded bolts 13 provide for adjustment of the adaptor rail 16 in the horizontal direction.

The adjusting screw 15 provides for pivoting of the pull-out section 24 or of the adaptor rail 16 about the axis of the bolt 36. The adaptor rail 16 is formlockingly retained, in a horizontal direction, relative to the pull-out rail 4 by the indexing bolt 33 against being lifted up by cooperation of the bearing disc 32 with the fishplate 38.

In the embodiment shown in the drawings (FIG. 14), the adaptor rail is formed as a one-piece member. However, it is within the scope of the invention to form the adaptor rail of several parts and connect them together with crossbolts and other connection means. In the embodiments of the adaptor rail shown in the drawings, the adaptor rail is formed as a one-piece part. As discussed above, the width B of the vertical web 18 of the adaptor rail 16 is smaller than the width A of the pull-out rail 4. To compensate for this width difference, the vertical webs 9 of the pull-out rail 4 can be provided with downward extending indentations, or these vertical webs 9 can be formed as free-stamped fishplates bent-out inward toward each other and acting as a plate spring, with the vertical web 18 of the adaptor rail 16 being received between the so-formed vertical webs 9. The front formlocking connection between the pull-out rail 4 and the adaptor rail 16 is insured by cooperation of the recessed groove 37 with the indexing bolt 33 and by cooperation of the bearing disc 32 with the fishplate 38.

The adaptor rail 16 supports the pull-out section 24 of the tall cupboard 1, which has a box-like shape (FIG. 1) in a manner shown and described above. It is, however, possible, to connect, with the pull-out device, a circumferentially closed framed formed of section tubes. In this case, the lower horizontal section of the frame is directly inserted in the pull-out rail 4 and is secured there. In this case, the lower horizontal frame section of the circumsferentially closed frame is constructively formed as the vertical web 18 of the T-shaped adaptor rail. When circumferentially closed frames are used, then the baskets or other containers are hanged up between the vertically extending legs of the lower section.

A further embodiment of a pull-out device according to the present invention, together with a supported thereby pull-out frame, will be described below with reference to FIGS. 16–26.

Figure 26:
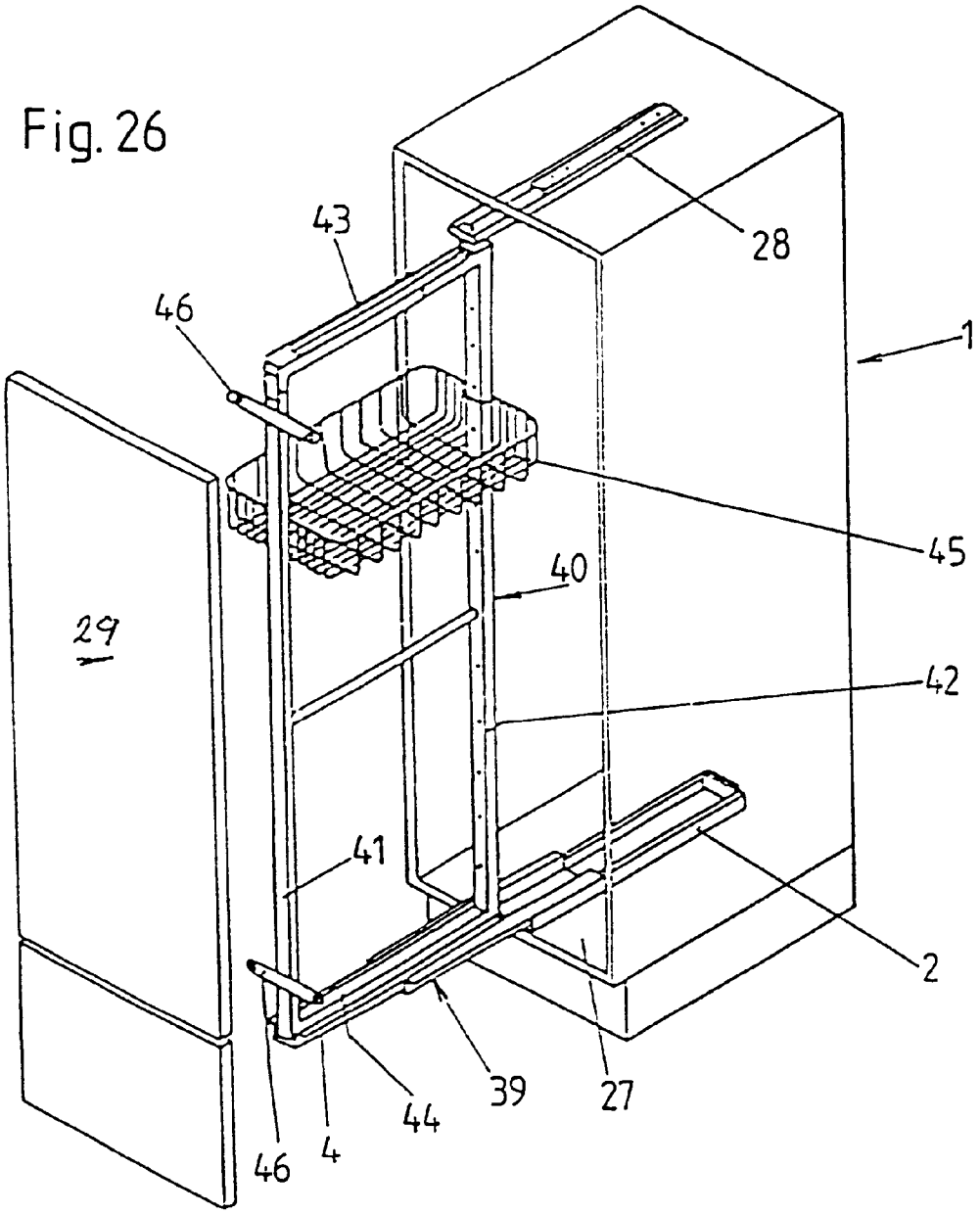
FIG. 26 shows a schematic perspective view of a tall cupboard with a pull-out frame in its pull-out condition.

As shown in FIG. 26, a multi-part pull-out device 39 is secured to the bottom 27 of a tall cupboard. A vertically extending pull-out frame 40, which is formed of vertical front and rear bars 41 and 42 and horizontal upper and lower bars 43 and 44, is secured to the pull-out device 39. An upper guide 28 engages the upper horizontal bar 43. The upper guide 28 is designed for stabilizing the pull-out frame 40. The separate frame bars 41, 32, 43, 44 can be formed as telescopic members, permitting to adapt the dimensions of the pull-out frame 40 to the dimensions of the tall cupboard 1. A plurality of baskets are hanged up between the vertical bars 41 and 42, of which only one is shown in the drawing. A frontal screen 29 is secured to the front vertical bar 41. The frontal screen 29 closes the tall cupboard 1 in the pull-in condition of the pull-out device 39. For connecting the front screen 29 to the pull-out frame 40, i.e., to the front vertical bar 41, braces 46 are provided on the front bar 41.

Figure 16:
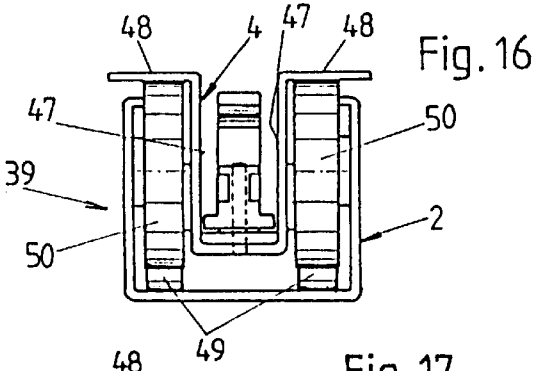
FIG. 16 shows a front view of a simplified pull-out device for a tall cupboard.
Figure 17:
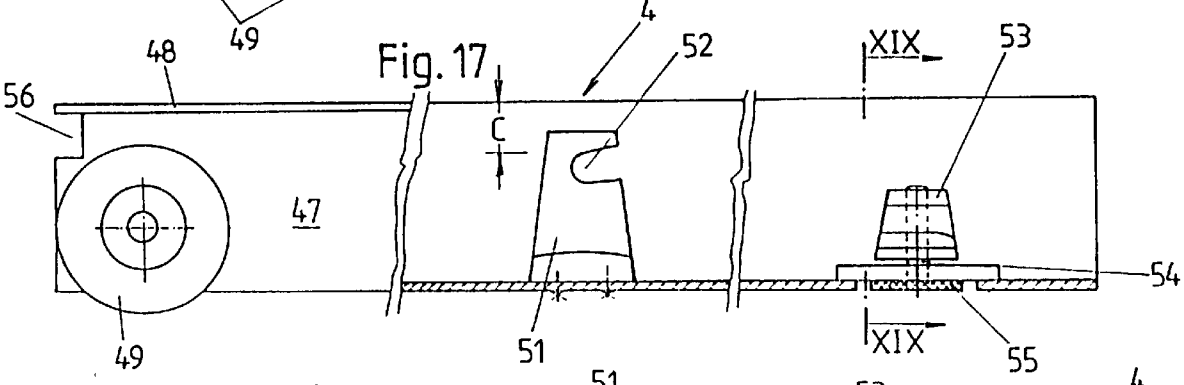
FIG. 17 shows a side view of the pull-out rail of the pull-out device shown FIG. 16.
Figure 18:
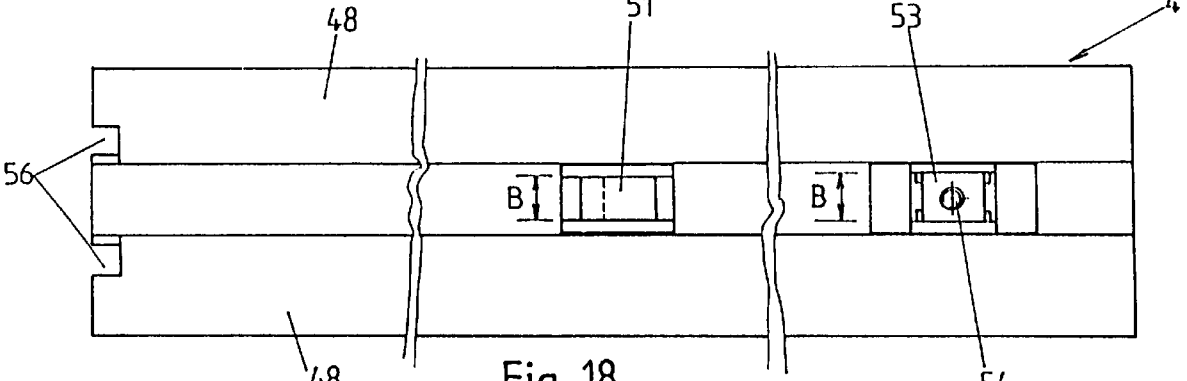
FIG. 18 shows a plan view of the pull-out rail shown in FIG. 17.
Figure 21:
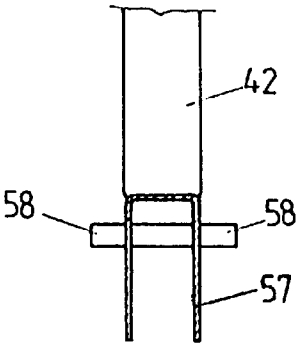
FIG. 21 shows a cross-sectional view along line XXI—XXI in FIG. 20.
Figure 22:
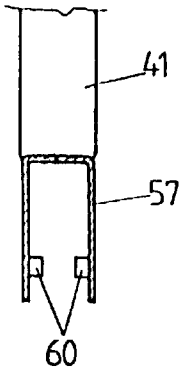
FIG. 22 shows a cross-sectional view along line XXII—XXII in FIG. 20.
Figure 20:
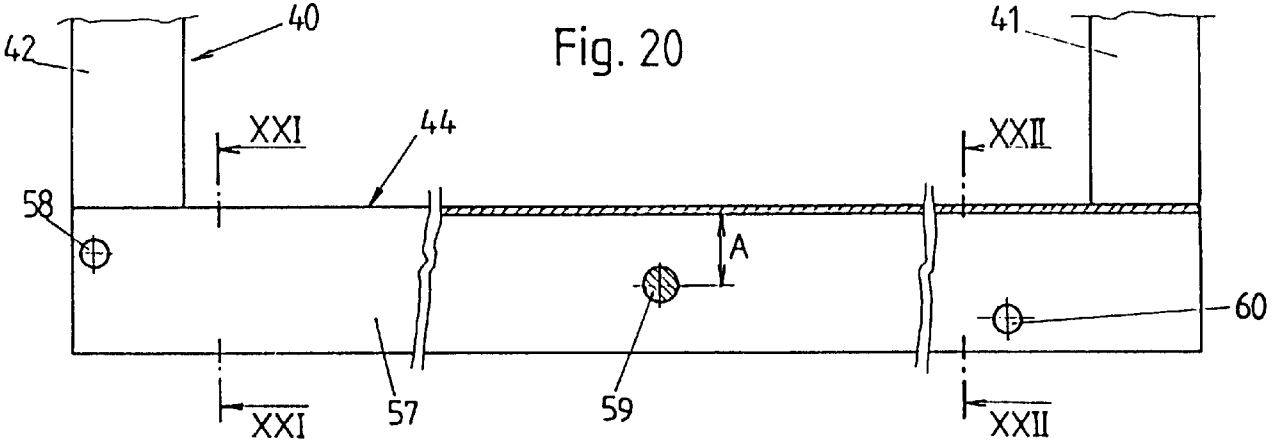
FIG. 20 shows a side view of a lower horizontal frame portion of a circumferentially closed pull-out frame.

A simplified pull-out device 39 used with tall cupboards is shown in FIG. 16. In this device, the pull-out rail has a U-shaped cross section with two vertical webs 47 and upper bent-out flanges 48. A pair of running freely rotatable rollers 49 is supported in the rear region of the pull-out rail 4. The pull out rail 4, together with the running rollers 49 is received in U-shaped carcass rail 2 which is secured to the bottom 27 of the tall cupboard 1. The pull-out device 39, which is shown in FIG. 26 has three rails, whereas the pull-out device 39 shown in FIG. 16 consists of two rails. The number of rails in a pull-out device is unimportant for the purposes of the present invention. Therefore, for the sake of clarity, the pull-out device 39 will be described with a reference to an embodiment consisting of two rails. The carcass rail 2 has, in its front region, two support rollers 50 which engage the side flanges 48 which serve as guiding tracks.

For the purposes of the invention, the important thing is the shape of the pull-out rail 4 and the lower horizontal bar 44 of the pull-out frame 40. The pull-out rail 4 has, in its longitudinally middle region, a hook member 51 which opens toward the front of the rail 4 and is located between the two vertical webs 47. The receiving opening 52 of the hook member 51 is limited by two, tapering toward each other flanges, with the size of the opening 52 being reduced toward its bottom. The opening 52 extend substantially horizontally.

Figure 19:
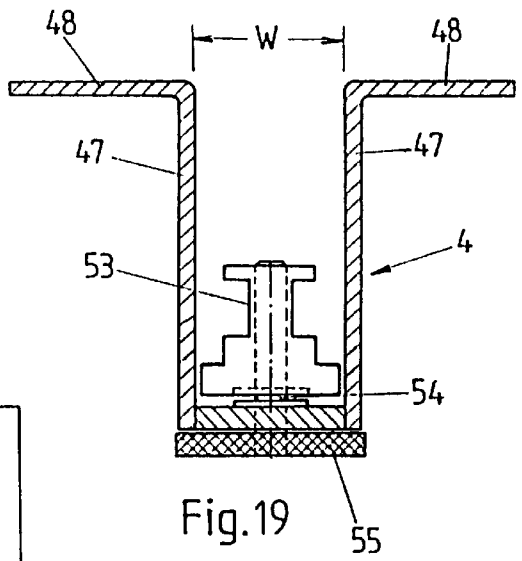
FIG. 19 shows a cross-sectional view along line XIX—XIX in FIG. 17.

A shaped member 53 is provided in the front region of the pull-out rail 4, likewise between the two vertical webs 47. The shaped member 53 has a I-shaped cross-section, as shown in FIG. 19. The shaped member 53 has a vertical threaded bore into which a threaded bolt 54 is screwed in. At the lower end of the threaded bolt 54, a knurled screw 55 is arranged. The diameter of the knurled screw 55 corresponds approximately to the spacing between the two vertical webs 47. Both the shaped piece 53 and the hook member 51 are smaller than the width W of the pull-out rail 4. It needs further to be mentioned that at the rear end of the pull-out rail 4, each vertical web 47 has a recessed opening 56 which extends up to the flange 48.

The lower horizontal bar 44 of the pull-out frame 40 is formed as a downwardly facing U-shaped profile 57. At its rear end, the profile 57 has a horizontally extending bolt 58. In the longitudinally middle region of the profile 57, in the upper half of the profile an inner bolt 59 is provided. The bolt 59 is located between the two vertical webs 47. On the inner side of the vertical webs of the U-shaped profile 57, in their front regions, bolts 60 are provided. The pull-out rail 4 and the lower horizontal bar 44 have substantially the same length, as in conventional with such pull-out devices. The distance A of the bolts 60 from the respective upper edges of the webs of the U-shaped profile 57 is larger than the distance C of the opening 52 of the hook member 51 from the upper edge of the pull-out rail 4.

Figure 23:
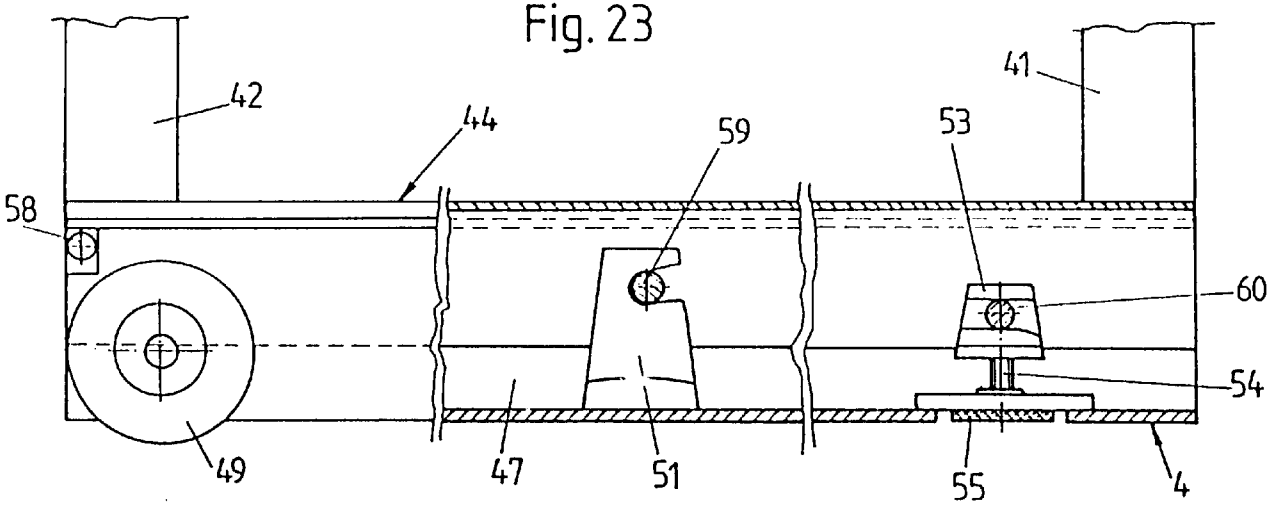
FIG. 23 shows a side view of a lower horizontal frame portion of a circumferentially closed pull-out frame supported on a pull-out rail.

The mounting of the frame 40 on the pull-out rail 4 is effected as follows. With the knurled screw 55, the shaped member 53 is displaced completely downward. Thereafter, the frame 40 or its lower horizontal bar 44 is inserted into the pull-out rail 4 and is so secured there that the bolts 58 lie on the flanges 48 approximately between the running rollers 49 and the hook member 51. Then, the pull-out frame 40 is pushed, with respect to the pull-out rail, rearwardly. At that, the bolts 58 slide on the flanges 48 until the bolt 49 enters the opening 52 of the hook member 51, as shown in FIG. 23. The bar 44 at that is in an inclined position, being inclined in a forward direction. Then, the shaped member 53 is lifted by rotating the knurled screw 55, and the bar 44 is rotated about the bolt 59 as about an axis until the bar 44 is located horizontally and parallel to the pull-out rail 4. The bolt 58, together with the rear end of the bar 44, are lowered and reach the rear recessed grooves 56. This fixes the frame 40 in the pull-out rail 4 horizontally and vertically.

Figure 24:
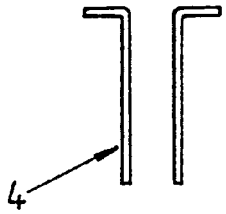
FIG. 24 shows a cross-section view of one embodiment of the pull-out rail.
Figure 25:
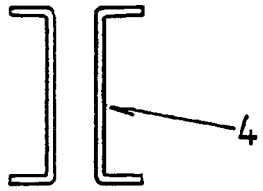
FIG. 25 shows a cross-sectional view of another embodiment of a pull-out rail.

The pull-out rail 4 can also have a cross-section shown in FIGS. 24–25. In this case, the pull-out rail 4 is formed of two symmetrically arranged profiles fixedly connected by a transverse web, not shown in the drawings.

Instead of the I-shaped member 53, here, a hook member can be provided the shape of which is similar to the hook member provided in the longitudinally middle region of the pull-out rail. Instead of the hook member 51, here, a I-shaped member can be provided. Thus, the hook member 51 and the I-shaped member 53 are interchangeable. The important thing is that one of the two members, on one hand, limits the displacement path of the bar 44 and, on the other had, the front end of the bar 44 can be lowered and lifted so that the bar 44 can be rotated about a transverse axis located in its longitudinal center. The advantage of using an I-shaped member consists in that the manufacturing tolerances need not be very high, i.e., the position of the bolts 59 relative to the position of the bolts 60 need not be precisely defined.

In the embodiment of the pull-out device shown in FIGS. 16–26, the shaped member 53 is adjustable along the stationary threaded bolt 54. It is within the scope of the invention, to screw the bolt 54 into a nut provided in the transverse spar located between the two webs 47, connecting the same. In this case, the shaped member 53 is secured on the upper end of the threaded bolt 54 with a possibility of rotation relative to the bolt 54 but without a possibility of axial displacement relative to the bolt 54, i.e., the shaped member is fixed axially. Upon rotation of the threaded bolt, the threaded bolt is displaced axially, carrying with it the shaped member 53.

The present invention was described and explained based on the construction of the pull-out frame 40. It is also possible to form the bar 44 as part of an adaptor rail. Thus, the bar 44 can be formed as a vertical web of a T-shaped adaptor rail which was described previously. Such an adaptor rail is used when instead of a pull-out frame, a section 24 is pulled out. In this case, the wide horizontal flange of the adaptor rail is secured to the bottom of a cupboard piece. Then, the cup-board piece, together with the adaptor rail is inserted into the pull-out device and is secured there, as it was discussed above with the reference to the first two embodiments.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A pull-out device for a tall cupboard including a pull-out section having bottom means, the pull-out device comprising a U-shaped carcass rail; a pull-out rail for supporting the pull-out section and having two spaced vertical webs; and an adaptor rail for connecting the bottom means of the pull-out section with the pull-out rail, the adaptor rail having means for securing the adaptor rail to the bottom means of the pull-out section and a vertical web formlocking by retaining between the vertical webs of the pull-out rail and securing against axial displacement relative to the pull-out rail, wherein the pull-out rail includes a hook member provided in a longitudinally middle region thereof and opening toward a front end of the pull-out rail, and a height-adjustable shaped member provided in a front region of the pull-out rail;

wherein the vertical web of the adaptor rail has a U-shaped cross-section which opens downwardly;

wherein at least one bolt is provided in the front region of the adaptor rail on the inner side of vertical web of the adaptor rail, the at least one bolt cooperating with one of the hook member and the shaped member, and wherein sidewise projecting bolts are provided at a rear end of the vertical web of the adaptor rail.

2. A pull-out device as set forth in claim 1, wherein the vertical web of the adaptor rail has a U-shaped cross-section;

wherein the hook member and the shaped member has a width which is at most equal to an inner width of the U-shaped vertical web.

3. A pull-out device as set forth in claim 2, wherein the shaped member is formed as a hook member having an open side thereof facing a front end of the pull-out rail.

4. A pull-out device as set forth in claim 2, wherein the shaped member has an I-shaped cross-section.

5. A pull-out device as set forth in claim 1, wherein the shaped member has a vertical threaded bore for receiving the at least one bolt.

6. A pull-out device as set forth in claim 5, wherein the at least one bolt has, at a lower end thereof, a knurling screw a diameter of which approximately corresponds to a spacing between the vertical webs of the pull-out rail.

7. A pull-out device as set forth in claim 6, wherein a bottom of the knurling screw is arranged substantially flush with a lower edge of the pull-out rail.

8. A pull-out device as set forth in claim 1, wherein the vertical web of the pull-out rail has, in a rear end surface thereof, recess means for receiving a sidewise projecting bolt provided on the web of the adaptor rail in a rear region thereof.

9. A pull-out device as set forth in claim 1, wherein a distance by which the at least one bolt is spaced from the upper edge of the adaptor rail is larger than a distance of a receiving opening of the hoot member from an upper edge of the pull-out rail.

10. A pull-out device for a tall cupboard including a pull-out device having bottom means, the pull-out device comprising a U-shaped carcass rail a pull-out rail for supporting the pull-out section and having two spaced vertical webs; an adaptor rail for connecting the bottom means of the pull-out section with the pull-out rail, the adaptor rail having means for securing the adaptor rail to the bottom means of the pull-out section and a vertical web formlocking by retaining between the vertical webs of the pull-out rail and securing against axial displacement relative to the pull-out rail; means for supporting the adaptor rail for pivotal movement relative to the pull-out rail; and means for adjusting an angular position of the adaptor rail relative to the pull-out rail.

11. A pull-out device as set forth in claim 10, further comprising an intermediate rail located between the carcass and pull-out rails; and running rollers supported on one of the intermediate and pull-out rails.

* * * * *